US007094118B1

(12) United States Patent
Phillips et al.

(10) Patent No.: US 7,094,118 B1
(45) Date of Patent: Aug. 22, 2006

(54) HEAT EXCHANGER FOR A MARINE PROPULSION SYSTEM

(75) Inventors: George E. Phillips, Oshkosh, WI (US); Wayne M. Jaszewski, Jackson, WI (US); Richard A. Davis, Mequon, WI (US); Claus Bruestle, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/087,894

(22) Filed: Mar. 23, 2005

(51) Int. Cl.
*F01P 3/20* (2006.01)
*B63H 21/30* (2006.01)

(52) U.S. Cl. ..... 440/88 HE; 440/111

(58) Field of Classification Search ..... 440/88 HE, 440/111; 165/44
See application file for complete search history.

(56) References Cited

U.S. PATENT DOCUMENTS 3,292,373 A * 12/1966 Tado ..... 60/221
3,650,310 A 3/1972 Childress ..... 165/44
4,220,121 A 9/1980 Maggiorana ..... 123/41.8
4,338,993 A 7/1982 Fernstrum ..... 165/44
5,746,270 A 5/1998 Schroeder et al. ..... 165/41
6,379,201 B1 4/2002 Biggs et al. ..... 440/88
6,544,085 B1 4/2003 Menard et al. ..... 440/88
6,748,906 B1 6/2004 White et al. ..... 123/41.01

* cited by examiner

*Primary Examiner*—Ed Swinehart
(74) *Attorney, Agent, or Firm*—William D. Lanyi

(57) ABSTRACT

The heat exchanger for a marine propulsion system is located within available space in front of the transom of a marine vessel and attached to the transom. The housing of the heat exchanger can be attached to a drive unit support structure and spaced apart from an engine of the marine propulsion system. Within the heat exchanger, engine coolant is circulated through a first coolant path and water from the body of water is circulated through a second coolant path.

2 Claims, 4 Drawing Sheets

HEAT EXCHANGER FOR A MARINE PROPULSION SYSTEM

BACKGROUND OF THE INVENTION

1. Field of the Invention

The present invention is generally related to a heat exchanger for a marine propulsion system and, more particularly, to a closed cooling system for a marine engine in which the heat exchanger is contained at a location spaced apart from the engine and supported by the transom of a marine vessel.

2. Description of the Related Art

Many different types of engine cooling systems are known for use in conjunction with marine propulsion systems. Some of these systems use an open cooling circuit in which water is drawn directly from a body of water and conducted into thermal communication with heat producing portions of the engine. Other cooling systems use a closed cooling circuit in which a coolant, such as ethylene glycol, is recirculated through cooling conduits of an engine to continually remove heat from heat producing portions of the engine. The engine coolant is then passed through a heat exchanger where heat is removed from the coolant by conducting the coolant in thermal communication with a raw water cooling conduit that directs a flow of water, from a body of water, through the heat exchanger. That raw water, after passing through the heat exchanger and removing heat from the engine coolant, is then returned to the body of water. These types of systems are well known to those skilled in the art.

U.S. Pat. No. 3,650,310, which issued to Childress on Mar. 21, 1972, describes a combination boat trim tab and heat exchanger. The trim tab body is hollow and has an inlet and outlet connected to the hollow interior and is adapted to be connected to the boat engine cooling system with elongate fins secured to the bottom of the outside of the body and axially aligned with the longitudinal axis of the boat. The hollow interior of the body includes a serpentine passageway between the inlet and outlet thereby increasing the heat exchange area in contact with the engine cooling liquid.

U.S. Pat. No. 4,220,121, which issued to Maggiorana on Sep. 2, 1980, discloses a heat exchanger for a marine propulsion engine. The heat exchanger is provided for a pressurized, closed cooling system for a marine propulsion engine. The heat exchanger includes a closed spiral passageway means for fresh cooling water drawn from the lake or other body of water. An outer housing encloses the spiral passageway and includes baffle means for directing of a coolant in a spiral path over the cooling passageway means within the housing. The coolant is thereby cooled by the circulating cold fresh water.

U.S. Pat. No. 4,338,993, which issued to Fernstrum on Jul. 13, 1982, describes an underwater outboard marine heat exchanger. A first water header is connected to a second water header by laterally spaced multiple parallel composite tubes in which each consists of two or more component tubes of vertically elongated rectangular cross-section welded to one another along their horizontal narrower adjoining faces. The height of each component tube is a multiplicity of times the width thereof.

U.S. Pat. No. 5,746,270 which issued to Schroeder et al. on May 5, 1998, discloses a heat exchanger for a marine engine cooling system. The heat exchanger assembly is provided for a marine propulsion system having a closed loop cooling system. The heat exchanger body encloses a series of tubes carrying seawater which removes heat from the engine coolant. The heat exchanger includes an integrally connected top tank. A single venting orifice is provided into the top tank from the heat exchanger body.

U.S. Pat. No. 6,379,201, which issued to Biggs et al. on Apr. 30, 2002, discloses a marine engine cooling system with a check valve to facilitate draining. The system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,544,085, which issued to Menard et al. on Apr. 8, 2003, describes a watercraft having a closed coolant circulating system with a heat exchanger that constitutes an exterior surface of the hull. The watercraft comprises a hull and an engine. It also comprises a heat exchanger formed from heat conductive material and having a fluid path defined therein with an inlet port and an outlet port. The heat exchanger has a heat exchanging exterior surface and is mounted to the hull such that the heat exchanging exterior surface constitutes a portion of the exterior surface of the hull that is normally disposed below the surface of the body of water.

U.S. Pat. No. 6,748,906, which issued to White et al. on Jun. 15, 2004, discloses a heat exchanger assembly for a marine engine. The heat exchanger for a marine internal combustion engine is disposed between first and second sides of a V-shaped engine configuration. A plurality of tubes and related structure are disposed within a cavity formed as an integral part of an air intake manifold of the engine. A first cooling fluid, such as ethylene glycol, is circulated in thermal communication with outer surfaces of the plurality of tubes within the heat exchanger and a second cooling fluid, such as lake or seawater, is circulated through the internal passages of the plurality of tubes. A conduit is provided within an end portion of the heat exchanger to remove heat from a lubricant, such as oil, of the internal combustion engine.

The patents described above are hereby expressly incorporated by reference in the description of the present invention.

It would be significantly beneficial if the heat exchanger, of a closed loop marine propulsion system, could be provided in which the heat exchanger is located at a convenient position within the structure of a marine vessel. It would also be significantly beneficial if the heat exchanger could be disposed within a space that is not required for other uses in typical sterndrive-type marine propulsion systems.

SUMMARY OF THE INVENTION

A marine propulsion system made in accordance with a preferred embodiment of the present invention comprises an engine, a drive unit, an engine cooling conduit, a drive unit support structure, a water conduit, and a heat exchanger. The engine is disposed at a first position which is forward of a transom of the marine vessel and has a generally horizontal driveshaft extending in a direction from the engine toward the transom. The generally horizontal driveshaft is supported for rotation about an axis of rotation which is generally horizontal. The drive unit is disposed at a second position which is rearward of the transom of the marine vessel. The engine cooling conduit is disposed in thermal communication with heat producing portions of the engine.

Typically, the engine cooling conduit comprises a cooling jacket which, in turn, comprises various cavities formed within the structure of the engine. The drive unit support structure is attached to the transom of the marine vessel and to the drive unit. The water conduit is provided for conducting water from a body of water and returning the water to the body of water. The heat exchanger defines a first coolant path and a second coolant path. The first coolant path is connected in fluid communication with the engine cooling conduit and the second coolant path is connected in fluid communication with the second water conduit. The heat exchanger is attached to the transom of the marine vessel. The first and second coolant paths are disposed in thermal communication with each other within the heat exchanger.

In a preferred embodiment of the present invention, the heat exchanger is rigidly attached to the drive unit support structure. The first and second coolant paths are physically isolated from each other to prevent mixing of the water from the water conduit and the coolant, such as ethylene glycol, from the engine cooling conduit. The heat exchanger, in a preferred embodiment of the present invention, comprises a housing that is formed as an integral part of the drive unit support structure.

In a particularly preferred embodiment of the present invention, the first coolant path is directed through a tubular conduit which is wound to form a generally annular structure. The generally annular structure is coaxial with the axis of rotation about which the driveshaft rotates. It should be understood that alternative embodiments of the present invention could use a series of thermally conductive plates which are stacked and supported within a housing structure of the heat exchanger instead of the tubular conduit described immediately above.

The second coolant path, in a preferred embodiment of the present invention, comprises a pool of water drawn from the body of water in which the marine vessel operates. In this embodiment, the tubular conduit of the first coolant path is immersed in the pool of water and water drawn from the body of water is caused to flow into and out of the pool of water contained within the housing of the heat exchanger and surrounding the tubular conduit.

Although a preferred embodiment of the present invention directs the engine coolant, such as ethylene glycol, through a tube which is immersed in the pool of water drawn from the body of water, it should be understood that these functions could be reversed. In other words, the water drawn from the body of water could alternatively be circulated through a tubular conduit within the heat exchanger and the engine coolant, such as ethylene glycol, could be directed to flow through a pool which is within the housing of the heat exchanger and which surrounds the outer surface of the tubular conduit through which the water from the body of water flows.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
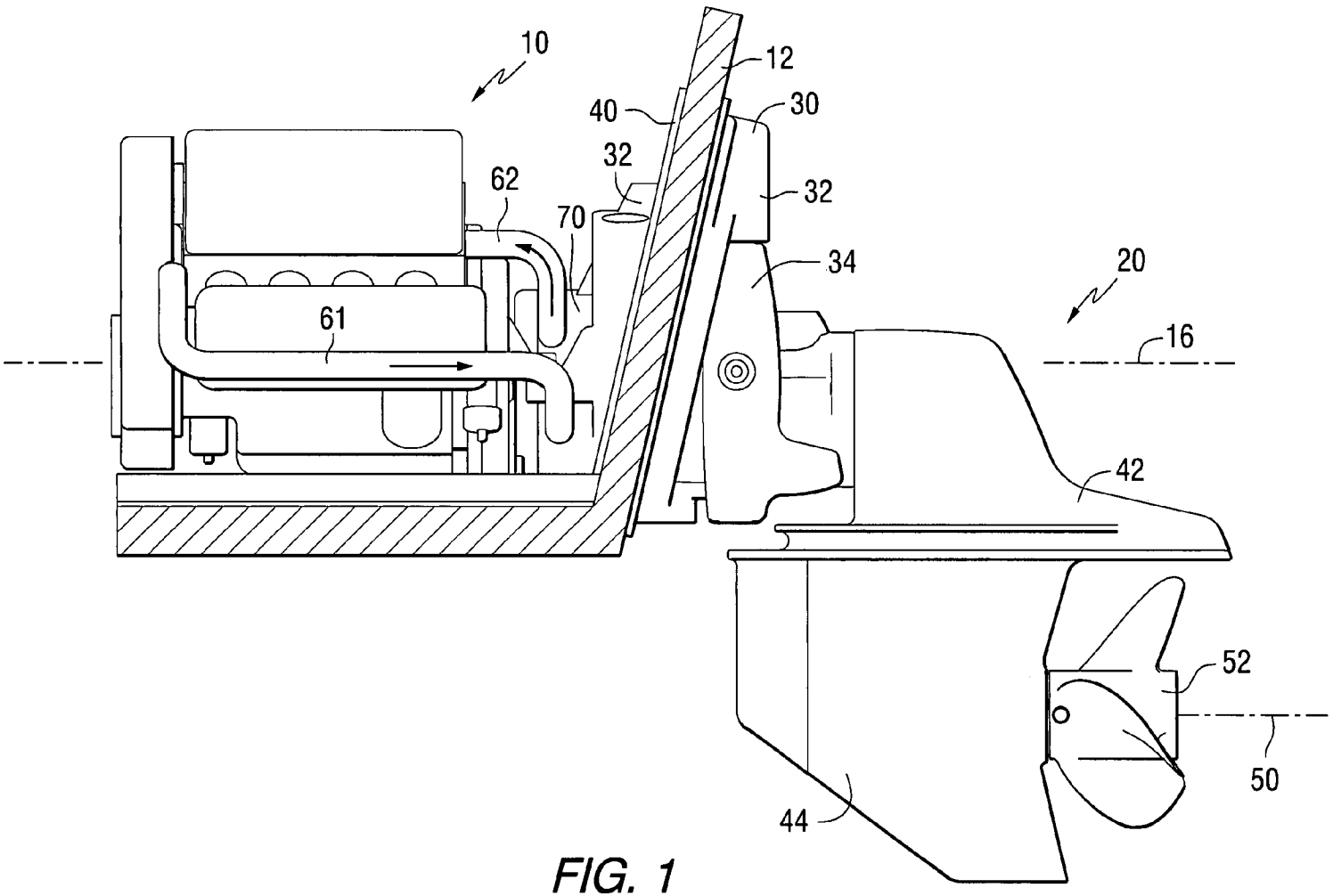
FIG. 1 is a side view of a marine propulsion system made in accordance with a preferred embodiment of the present invention.

Throughout the description of the preferred embodiment of the present invention, like components will be identified by like reference numerals.

FIG. 1 is a side view of a marine propulsion system which comprises an engine 10 which is disposed at a first position which is forward of a transom 12 of the marine vessel. The engine 10 defines a generally horizontal axis of rotation 16 about which its driveshaft rotates. Although not shown in FIG. 1, the driveshaft extends from the engine 10 in a rearward direction toward the transom 12.

A drive unit 20 is disposed at a second position, as illustrated in FIG. 1, which is rearward of the transom 12. As is generally known to those skilled in the art of marine propulsion systems, an engine cooling conduit, such as a water jacket, is formed within the engine 10 and disposed in thermal communication with heat producing portions of the engine. A drive unit support structure 30 is attached to the transom 12 and to the drive unit 20. It comprises a gimbal ring housing 32 which supports a gimbal ring 34 that allows the drive unit 20 to rotate about its generally vertical steering axis and generally horizontal trim axis.

A water conduit, which is not visible in FIG. 1, is provided within the structure of the drive unit 20 and the drive unit support structure 30. The water conduit is intended to conduct water from a body of water in which the marine vessel is operated and then return that water back to the body of water.

With continued reference to FIG. 1, several other basic components of the marine propulsion system are also shown. An inner transom plate 40 is provided for the purpose of attachment of the drive unit support structure 30 to the transom 12. The drive unit 20 comprises a driveshaft housing portion 42 and a gear case 44 which supports a propeller shaft for rotation about an axis of rotation 50. A propeller 52 is attached to a propeller shaft.

With continued reference to FIG. 1, two hoses, 61 and 62, are illustrated. These hoses are part of the closed cooling system through which the engine coolant flows. The hose identified by reference numeral 61 conducts the engine coolant from the engine to an inlet of a heat exchanger housing structure in the direction represented by the arrow shown in association with hose 61. Hose 62 conducts the engine coolant from the heat exchanger back to the engine cooling conduit, such as the water jacket, for recirculation within the closed cooling loop. Reference numeral 70 generally indicates the heat exchanger which, in a preferred embodiment of the present invention, is attached to the transom 12 through its attachment to the drive unit support structure 30.

Figure 2:
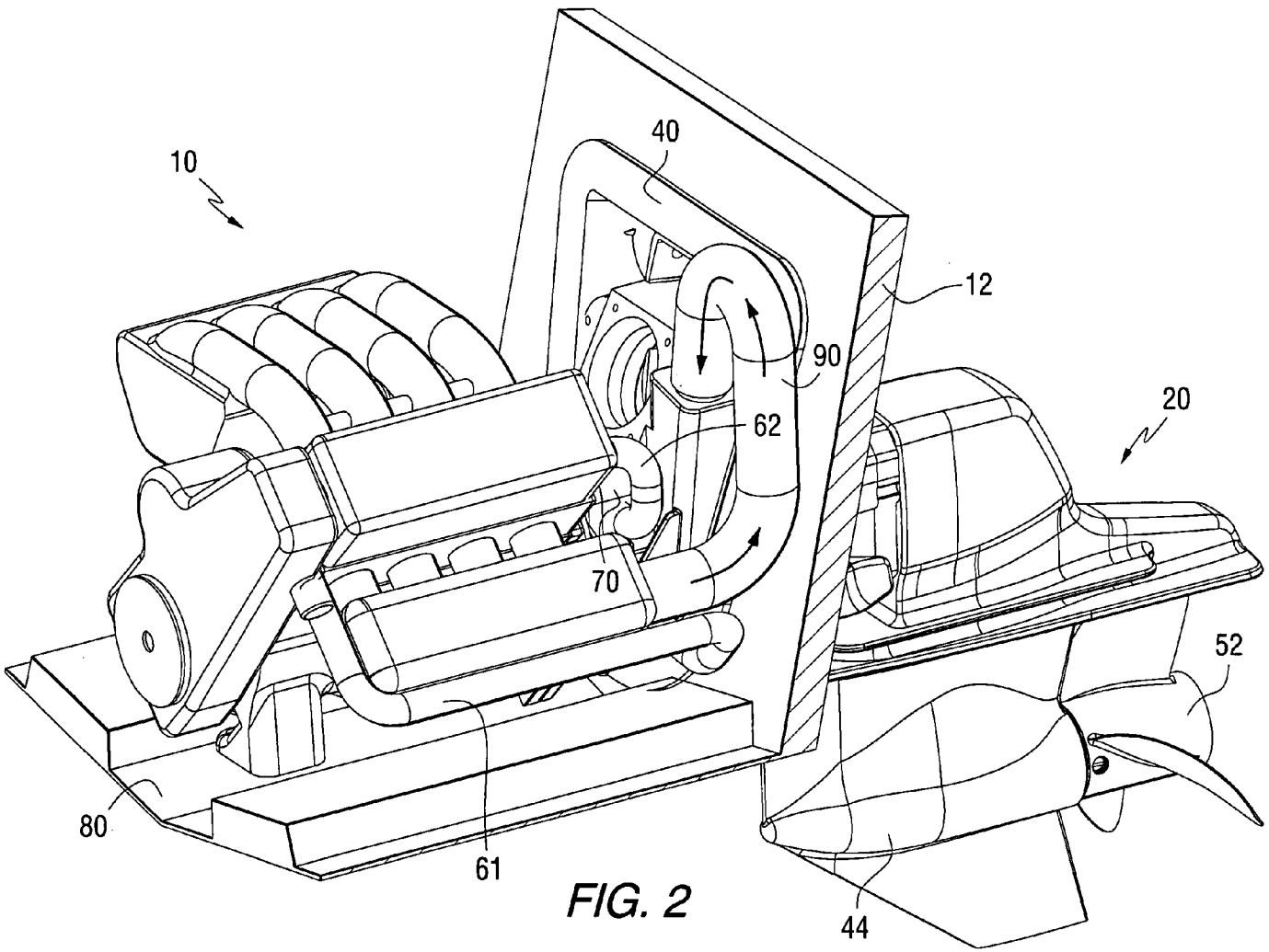
FIG. 2 is an isometric view of a marine propulsion system made in accordance with a preferred embodiment of the present invention.

FIG. 2 is an isometric representation of a portion of the marine propulsion system. It should be understood that, in FIG. 2, only a representative portion of the transom 12 and the boat hull 80 are shown. The engine 10 is illustrated at its first position which is forward of the transom 12 and the drive unit 20 is illustrated at its second position which is rearward of the transom 12.

With continued reference to FIG. 2, an exhaust gas conduit 90 is illustrated at its position between an exhaust outlet of the engine 10 and an exhaust inlet of the drive unit support structure. The arrows associated with the exhaust conduit 90 in FIG. 2 show the direction of exhaust gas flow within its structure. The exhaust gas then is directed, through internal channels, through the drive unit support structure 30, which is described above in conjunction with FIG. 1. The exhaust gases are then directed to one or more exhaust outlets associated with the drive unit 20. These exhaust outlets can be through the propeller 52 or through an above-water outlet which is typically operative during idle speed operation of the engine 10.

Figure 3:
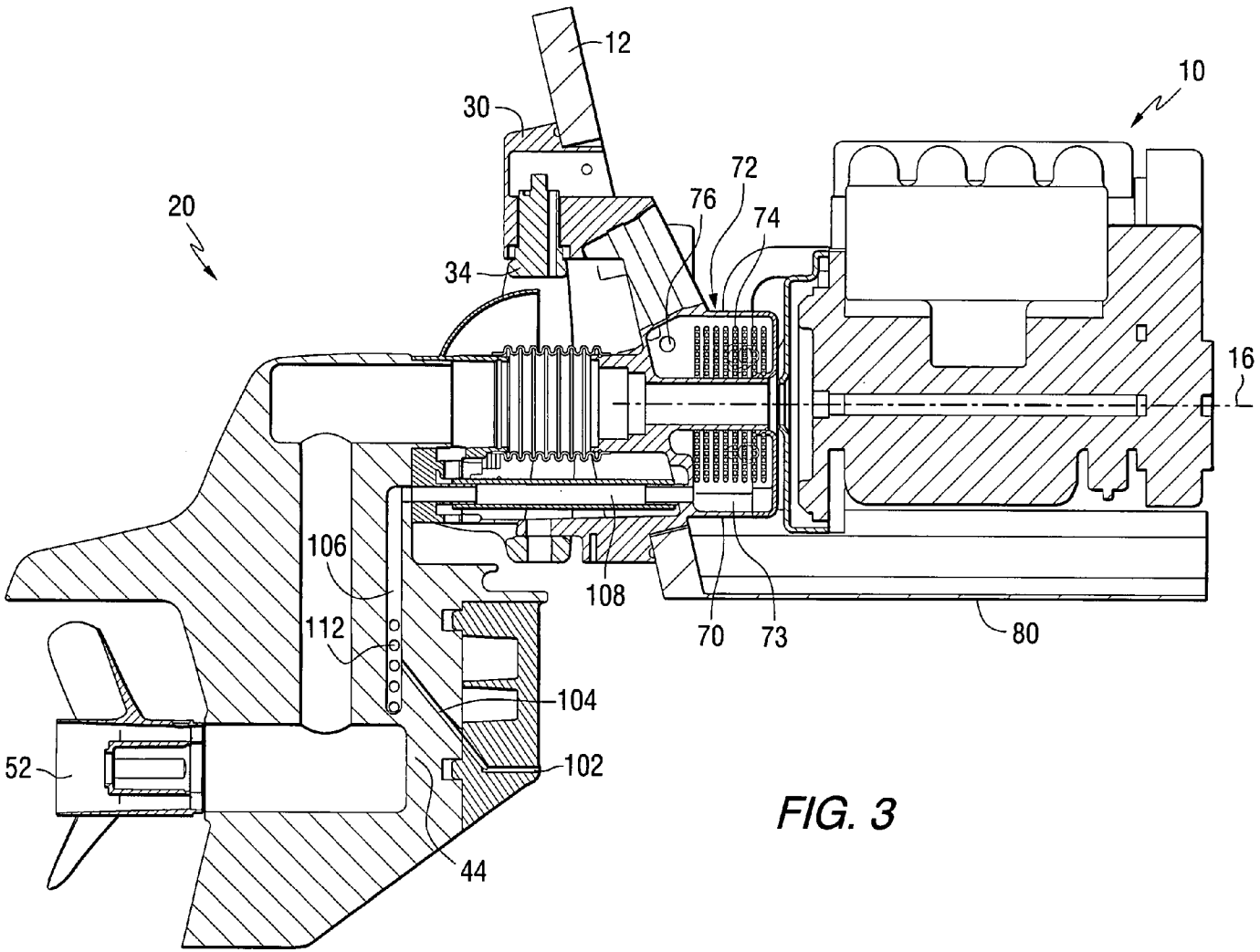
FIG. 3 is a section side view of a marine propulsion system made in accordance with a preferred embodiment of the present invention.

FIG. 3 is a section view of a marine propulsion system made in accordance with a preferred embodiment of the present invention. The purpose of the section view of FIG. 3 is to illustrate several characteristics of the present invention which relate to the manner in which the engine coolant, such as ethylene glycol, is circulated in its closed loop and, in addition, how water is directed from the body of water and conducted to flow through the heat exchanger 72 of the present invention.

With continued reference to FIG. 3, a water conduit is provided for conducting water from the body of water and returning that water to the body of water after it has been used. This water conduit comprises an inlet 102 which causes water to be drawn from the body of water as the drive unit 20 moves in a forward direction toward the right in FIG. 3. That water is conducted through conduit 104 and conduit 106 as part of its upward flow through the drive unit 20. From conduit 108, the water is caused to flow into the heat exchanger 72 to form a pool surrounding the coil 74. After filling the internal cavity of the housing structure 70, the water flows from the pool through opening 76 and is subsequently conducted into the exhaust gas conduit described above in conjunction with FIG. 2. That water is then returned to the body of water in a manner generally known to those skilled in the art. A plurality of holes 112 is also shown in FIG. 3. These provide access openings through which water can be drawn from the body of water in which the marine vessel is operated and conducted into conduit 106. Openings 102 and 112 provide dual parallel sources through which water can be drawn from the body of water.

Figure 4:
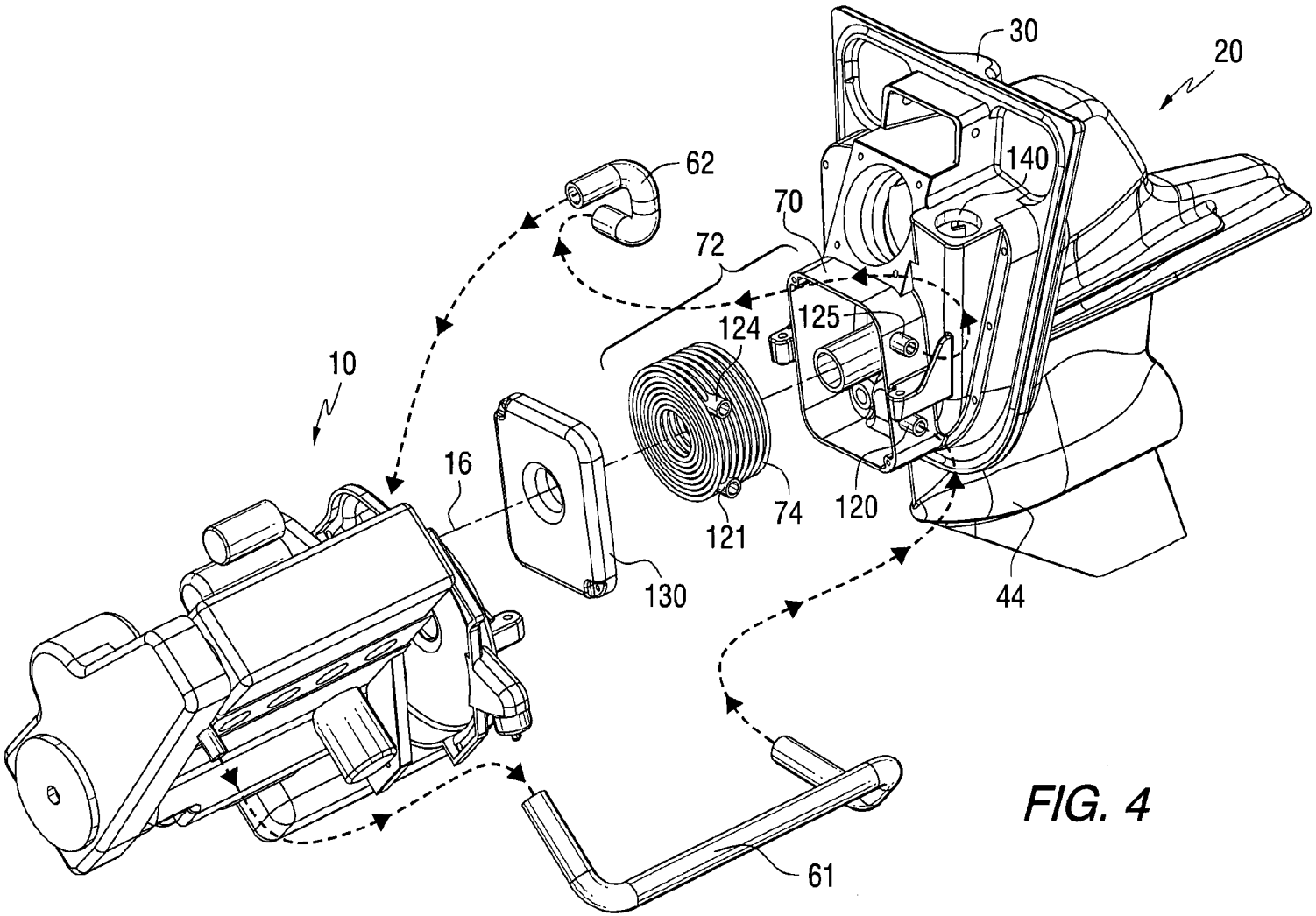
FIG. 4 is an exploded isometric view of a preferred embodiment of the present invention.

FIG. 4 is an exploded isometric view of a marine propulsion system incorporating the concepts of a preferred embodiment of the present invention. The engine cooling circuit, which includes the openings or cavities formed within the engine block as part of the cooling jacket, also comprises the hose 61, the coil 74, and the hose 62. The dashed line arrows in FIG. 4 illustrate the path of the engine coolant, such as ethylene glycol, as it passes through the engine 10 and the heat exchanger 72. The engine coolant flows through hose 61 and into port 120 which is directly connected in fluid communication with an inlet 121 of the wound coil 74 which provides the first coolant path of the heat exchanger. After passing through the length of the coil 74, the engine coolant flows out of an outlet 124 which is directly connected in fluid communication with an outlet 125 of the housing 70 of the heat exchanger 72. From there, the engine coolant flows through hose 62 and back to the engine 10 at a location which is not visible in FIG. 4 because it is located on the opposite side of the engine. A cover 130 attaches to the housing 70 to define a cavity therein. That cavity surrounds the outer surface of the coil 74. As an engine coolant flows through the internal passageway defined by the coil 74, water from a body of water flows through the cavity surrounding the coil 74 within the heat exchanger 72. This housing 70 defines the pool which receives water pumped from the body of water and circulates that water in thermal communication with the outer surface of the coil 74. That pool defines a second coolant path which is described above. After passing through the pool, water pumped from the body of water is caused to flow into an exhaust conduit to be returned to the body of water. The exhaust conduit 90, which is described above in conjunction with FIG. 2, is not shown in FIG. 4. However, it can be seen that an exhaust opening 140 is formed in the drive unit support structure 30 to receive an outlet end of the exhaust conduit 90.

With reference to FIGS. 1–4, it can be seen that a marine propulsion system made in accordance with a preferred embodiment of the present invention comprises an engine 10 disposed at a first position which is forward of a transom 12 of a marine vessel. The engine has a driveshaft which is supported for rotation about a generally horizontal axis of rotation 16. The driveshaft extends rearwardly from the engine 10 toward the transom 12. A drive unit 20 is disposed at a second position which is rearward of the transom 12. An engine cooling conduit, such as a water jacket of the engine 10, is disposed in thermal communication with heat producing portions of the engine. A drive unit support structure 30 is attached to the transom 12 and to the drive unit 20. A water conduit, which comprises conduits 102, 104, and 106, also comprises hose 108 and openings 112. This water conduit conducts water from a body of water and returns the water to the body of water through an opening identified by reference numeral 76 in FIG. 3. A heat exchanger 72 defines a first coolant path and a second coolant path. The first coolant path is connected in fluid communication with the engine cooling circuit, through hoses 61 and 62, and the second coolant path is connected in fluid communication with the water conduit described above. The heat exchanger 72 is attached to the transom 12. The first and second coolant paths, which flow through the coil 74 and the pool within the housing structure 70, respectively, are disposed in thermal communication with each other within the heat exchanger 72. The heat exchanger is rigidly attached to the drive unit support structure 30 and the first and second coolant paths are physically isolated from each other to prevent mixing of the water from the water conduit and the coolant from the engine cooling conduit. The heat exchanger 72 comprises a housing 70 that is formed as an integral part of the drive unit support structure 30 in a preferred embodiment of the present invention. This integral nature of the housing 70 is illustrated in FIGS. 3 and 4.

In a preferred embodiment of the present invention, the first coolant path is directed through a tubular conduit 74 and the tubular conduit 74 is wound to form a generally annular structure, as specifically shown in FIG. 4. The generally annular structure is coaxial with the axis of rotation 16. This relationship is shown in FIGS. 3 and 4. The second coolant path comprises a pool of water, within the housing 70 and surrounding the outer surface of the coil 74, which is drawn or pumped from the body of water.

Although the present invention has been described with particular specificity and illustrated to show a preferred embodiment of the present invention, it should be understood that alternative configurations are also within its scope.

We claim:

1. A marine propulsion system, comprising:

an engine disposed at a first position which is forward of a transom of a marine vessel, said engine defining a generally horizontal driveshaft axis or rotation extending in a direction from said engine toward said transom;

a drive unit disposed at a second position which is rearward of said transom of said marine vessel;

an engine cooling conduit disposed in thermal communication with a heat producing portion of said engine;

a drive unit support structure attached to said transom and to said drive unit;

a water conduit for conducting water through said drive unit from a body of water and returning said water to said body of water; and a heat exchanger which defines a first coolant path and a second coolant path, said first coolant path connected in fluid communication with said engine cooling conduit, said second coolant path connected in fluid communication with said water conduit, said heat exchanger being attached for support to said drive unit support structure, said first and second coolant paths being disposed in thermal communication with each other within said heat exchanger, said first and second coolant paths being physically isolated from each other to prevent mixing of said water from said water conduit and a coolant from said engine cooling conduit, said heat exchanger comprising a housing that is formed as an integral part of said drive unit support structure, said first coolant path being directed through a tubular conduit which is wound to form a generally annular structure.

2. A marine propulsion system, comprising:

an engine disposed at a first position which is forward of a transom of a marine vessel, said engine defining a generally horizontal driveshaft axis or rotation extending in a direction from said engine toward said transom;

a drive unit disposed at a second position which is rearward of said transom of said marine vessel;

an engine cooling conduit disposed in thermal communication with a heat producing portion of said engine;

a drive unit support structure attached to said transom and to said drive unit;

a water conduit for conducting water through said drive unit from a body of water and returning said water to said body of water; and a heat exchanger which defines a first coolant path and a second coolant path, said first coolant path connected in fluid communication with said engine cooling conduit, said second coolant path connected in fluid communication with said water conduit, said heat exchanger being attached for support to said drive unit support structure, said first and second coolant paths being disposed in thermal communication with each other within said heat exchanger, said first and second coolant paths being physically isolated from each other to prevent mixing of said water from said water conduit and a coolant from said engine cooling conduit, said heat exchanger comprising a housing that is formed as an integral part of said drive unit support structure, said first coolant path being directed through a tubular conduit which is wound to form a generally annular structure, said generally annular structure being coaxial with said axis of rotation.

* * * * *